United States Patent [19]

Laimer

[11] Patent Number: 4,561,638

[45] Date of Patent: Dec. 31, 1985

[54] INSTALLATION WITH A REFRACTORILY LINED METALLURGICAL VESSEL

[75] Inventor: Freidrich Laimer, Perg, Austria

[73] Assignee: Voest-Alpine Aktiengesellschaft, Linz, Austria

[21] Appl. No.: 687,949

[22] Filed: Dec. 31, 1984

[30] Foreign Application Priority Data

Jan. 9, 1984 [AT] Austria ..... 33/84

[51] Int. Cl.[4] ..... C21C 5/46

[52] U.S. Cl. ..... 266/158; 266/142; 266/281; 266/287

[58] Field of Search ..... 266/158, 142, 143, 281, 266/287

[56] References Cited

U.S. PATENT DOCUMENTS

| | | | |
|---|---|---|---|
| 3,495,812 | 2/1970 | Puxkandl et al. | 266/158 |
| 3,580,556 | 5/1971 | Roscoe | 266/158 |
| 4,212,453 | 7/1980 | Laimer et al. | 266/158 |
| 4,253,646 | 3/1981 | Goto et al. | 266/281 |

FOREIGN PATENT DOCUMENTS

| | | | |
|---|---|---|---|
| 1583307 | 10/1971 | Fed. Rep. of Germany . | |
| 212283 | 11/1968 | U.S.S.R. | 266/158 |

*Primary Examiner*—L. Dewayne Rutledge
*Assistant Examiner*—Robert L. McDowell
*Attorney, Agent, or Firm*—Brumbaugh, Graves, Donohue & Raymond

[57] ABSTRACT

There is disclosed an installation with a refractorily lined metallurgical vessel. The vessel, on its upper end, is provided with a mouth that is connectable to a chimney arranged at a distance above the mouth, by a hood insertable between the mouth and the chimney. In order to provide an installation with which the lining team is not jeopardized and by which it is possible to introduce the lining material into the metallurgical vessel in a simple and time-saving manner, a container is introduceable into the space present between the mouth and the chimney after the removal of the hood. The container covers the chimney downwardly and includes at least one closeable bottom opening. The carrying means for introducing the container is equipped with at least one hoist displaceable from laterally beside the mouth of the vessel to above the mouth of the vessel.

10 Claims, 6 Drawing Figures

INSTALLATION WITH A REFRACTORILY LINED METALLURGICAL VESSEL

Figure 1:
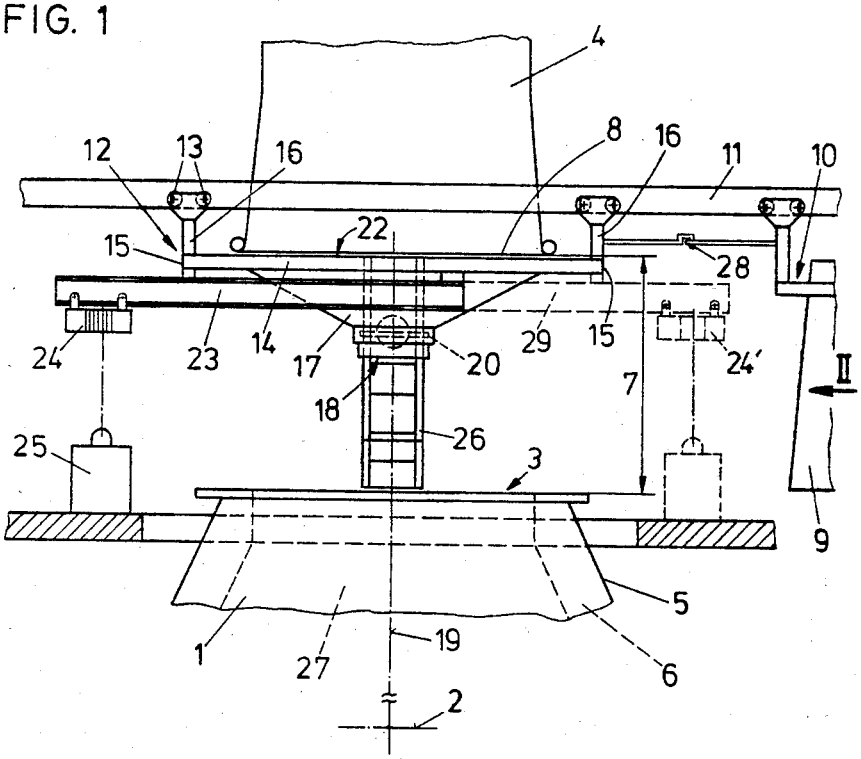

The invention relates to an installation with a refractorily lined metallurgical vessel, in particular a steel works converter, which, on its upper end, is provided with a mouth that is connectable to a chimney arranged at a distance above the mouth by means of a hood insertable between the mouth and the chimney.

In order to be able to line the metallurgical vessel, the entire lining material must be introduced into the vessel from above in the case of vessels with fixed bottoms. With a vessel having a removable bottom, only the material for lining and sealing the bottom joint must be introduced into the vessel from above.

In order to render the mouth of the vessel accessible, it is known with installations of the initially defined kind (U.S. Pat. No. 4,212,453; German Auslegeschrift No. 1,583,307) to laterally move or lift the hood provided between the mouth and the chimney. During lining works within the metallurgical vessel, the lining team is jeopardized by pieces of slag, such as skulls, which fall down from the chimney. In order to avoid such a hazard, the lower opening of the chimney has been covered with plates. This is cumbersome and time-consuming. When removing the plates, slag that had fallen onto the plates was stripped off, falling down into the newly lined converter. Furthermore, transportable floor sections had to be established near the mouth for the purpose of lining, via which floor sections the lining material was conveyable from the region of the hall crane to the mouth. A separate hoist had to be mounted on the floor to lower the lining material.

The invention aims at avoiding these disadvantages and difficulties and has as its objects to provide an installation of the initially defined kind, with which the lining team is not jeopardized and by which it is possible to introduce the lining material into the metallurgical vessel in a simple and time-saving manner.

This object is achieved according to the invention in that, after the removal of the hood, a container downwardly covering the chimney and including at least one closeable bottom opening is introduceable into the space present between the mouth and the chimney by a carrying means, which is equipped with at least one hoist displaceable from laterally beside the mouth of the vessel to above the mouth of the vessel.

The container covering the chimney serves to collect parts falling down from the chimney, such as slag skulls, and to prevent them from slipping into the metallurgical vessel as the container is removed. The hoist, which is displaceably arranged on the carrying means, automatically get into the operation position when positioning the container, in which position lining materials deposited laterally beside the vessel can be introduced into the vessel.

According to a preferred embodiment, the carrying means is designed as a frame displaceable along rails, and on which at least one runner projecting to laterally beside the mouth of the vessel is provided for the hoist.

For an efficient operation with a simple construction, the runner suitably is designed to be elongated on both sides of the vessel to lateral of the vessel mouth and is equipped with two hoists.

Advantageously, two parallel runners are provided to accommodate at least one hoist each.

A preferred embodiment is characterized in that the container is formed by a hopper and comprises a hopper orifice that lies centrally above the mouth and is closeable by means of a slide, the runner being arranged closely laterally beside the hopper orifice. The hopper-like design of the container makes feasible a simple evacuation of the same by opening the hopper orifice. With a metallurgical vessel having a removable bottom this may be effected prior to mounting the bottom, through the vessel into the slag cellar, and with a vessel having a fixed bottom this may be effected after a lateral displacement of the carrying means, the slag collected falling into a transportable chute.

An embodiment with which the lining material is introduceable into the center of the metallurgical vessel is characterized in that the container is formed by two adjacently disposed hoppers, the runner being arranged between the hoppers in a plane laid through the vertical axis of the mouth.

Advantageously, the carrying means is provided with a working platform introduceable into the vessel through the mouth, which offers the possibility, with metallurgical vessels having fixed bottoms, to line such a vessel from above without necessitating a separate stand.

Advantageously, the carrying means is provided with an accessible path, the interior of the vessel thus being observable from the mouth of the vessel.

With an installation comprising a hood that is movable along rails, the carrying means advantageously is movable along the rails guiding the hood and is connectable to the hood or to a moving mechanism carrying the hood.

Figure 2:
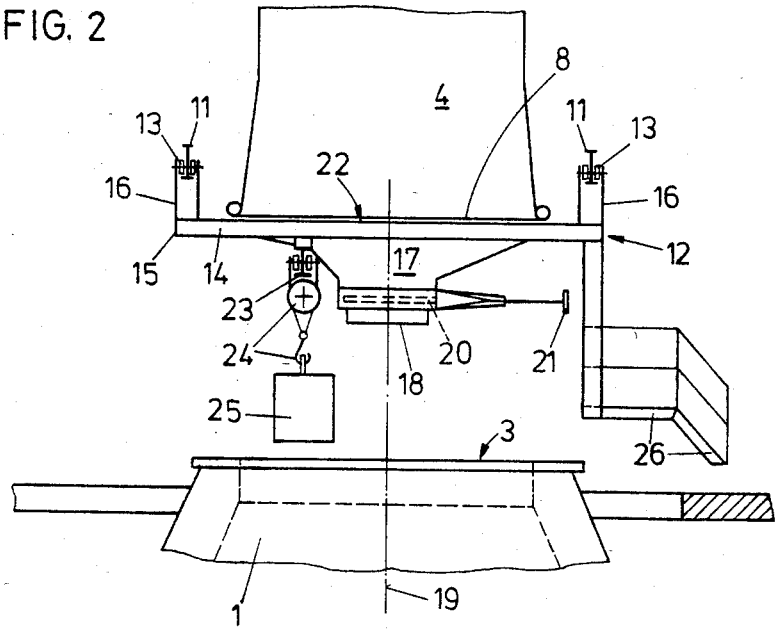

The invention is going to be explained in more detail by way of three embodiments and with reference to the accompanying drawings, wherein:

FIG. 1 is a partially sectioned side view of a converter installation in a schematic illustration according to a first embodiment;

FIG. 2 also is a partially sectioned side view in the direction of the arrow II of FIG. 1;

FIGS. 3 and 4, and 5 and 6, respectively, show two further advantageous embodiments in illustrations analogous to FIGS. 1 and 2.

A steel works converter 1 is tiltable about a horizontal axis 2, its mouth 3 being below a stationary chimney 4 with the converter 1 being in the upright position. The converter 1 comprises a steel shell 5 and a refractory lining 6 on its inner side. The chimney 4 ends in a vertical distance 7 above the mouth 3 of the converter 1. Between the lower end 8 of the chimney 4 and the mouth 3 of the converter 1, a hood 9 is introduceable by means of a moving mechanism 10, which is displaceable along rails 11 arranged on either side of the lower end 8 of the chimney 4. The hood 9 has such dimensions that it connects to the mouth 3 of the converter 1 on the one and hand to the lower end 8 of the chimney 4 on the other hand, flue gases leaving the converter 1 thus reaching the chimney 4 directly without annoying the environment.

Along the rails 11 supporting the hood 9 and its moving mechanism 10, a carrying means 12 is movable by wheels 13 according to the invention, which carrying means 12 is comprised of a frame 14 peripherally surrounding the chimney 4 and being positionable closely below the lower end 8 of the chimney. On this frame, vertical props 16 are provided in the corner points 15, on which the wheels 13 are journaled. Within the frame 14, a container 17 is mounted, which is designed as a hopper whose lower hopper orifice 18 is disposed centrally, i.e. in the vertical axis 19 laid through the mouth 3. The hopper orifice 18 is closeable by means of a slide 20, for whose actuation a hand wheel 21 is provided. The upper orifice 22 of the hopper corresponds to the lower end 8 of the chimney 4 in terms of shape and size.

To the frame 14, a runner 23 is mounted laterally of the lower hopper orifice 18 and closely neighboring the same, which, as is apparent from FIG. 1, extends from above the mouth 3 of the converter 1 to laterally beside the same. Along this runner, a hoist 24 is displaceable to transport lining material 25 for the converter 1.

Furthermore, an accessible path 26 is fastened to the carrying means 12, from which the interior 27 of the converter 1 is visible with the carrying means 12 positioned above the mouth 3.

In order to do without a separate drive for the carrying means, the carrying means is connectable to the displaceable hood 9 by means of a schematically illustrated coupling 28. As soon as the hood 9 is moved off the mouth 3 of the converter 1 by means of a drive (not illustrated), the carrying means 12 automatically gets into the operation position illustrated in FIGS. 1 and 2, together with the hopper 17 and the hoist 24.

In FIG. 1 an elongation 29 of the runner 23 has been entered in broken lines, whereby it is possible to displace two hoists 24, 24' along the same runner 23 from laterally beside the converter 1 to above the mouth 3 of the converter. This embodiment is advantageous particularly with a converter 1 having a fixed bottom, which can be lined only from above. For a converter with a removable bottom—converters of this type preferably are lined from below—a single hoist 24 will do, which must introduce into the interior 27 of the converter only the material for lining and sealing the joint between bottom and converter shell.

Figure 3:
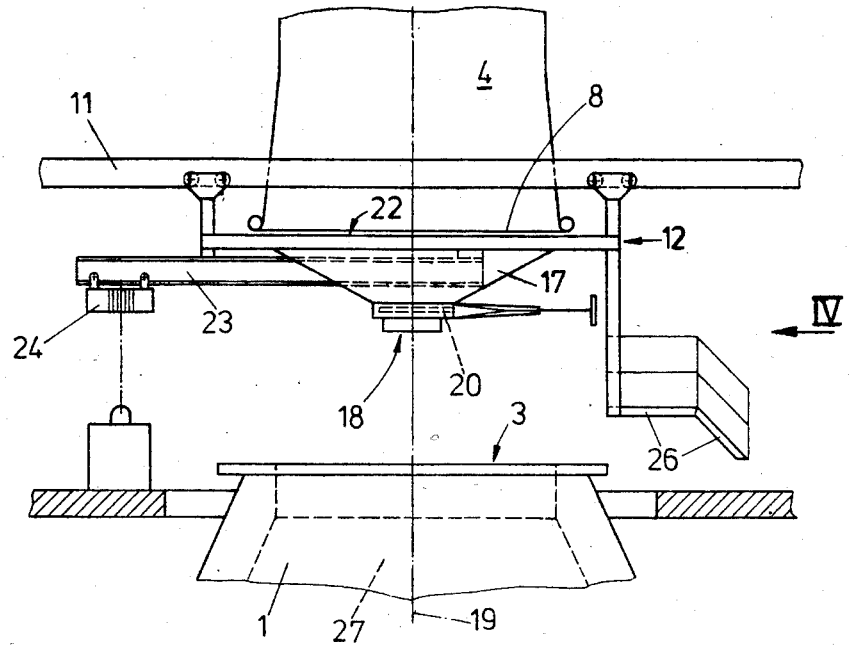
Figure 4:
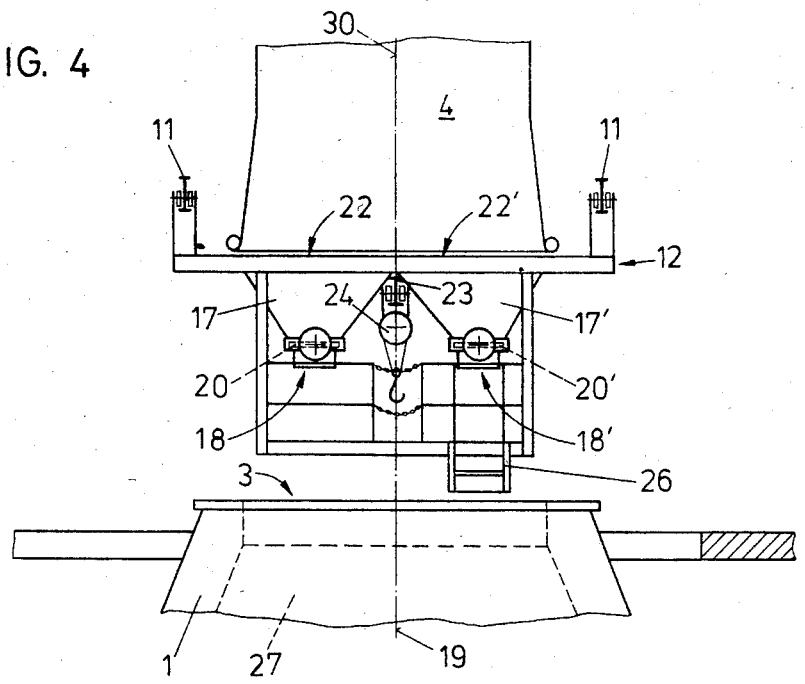
Figure 5:
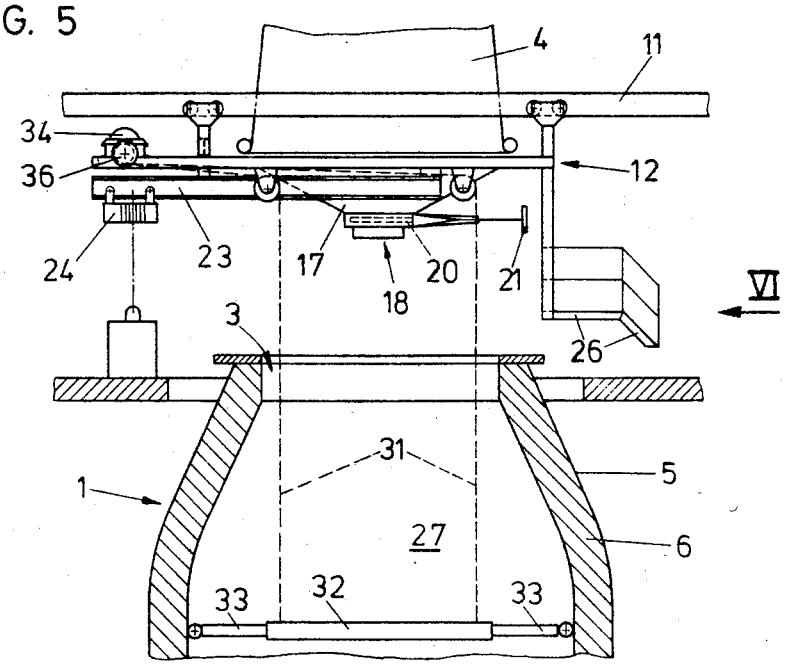
Figure 6:
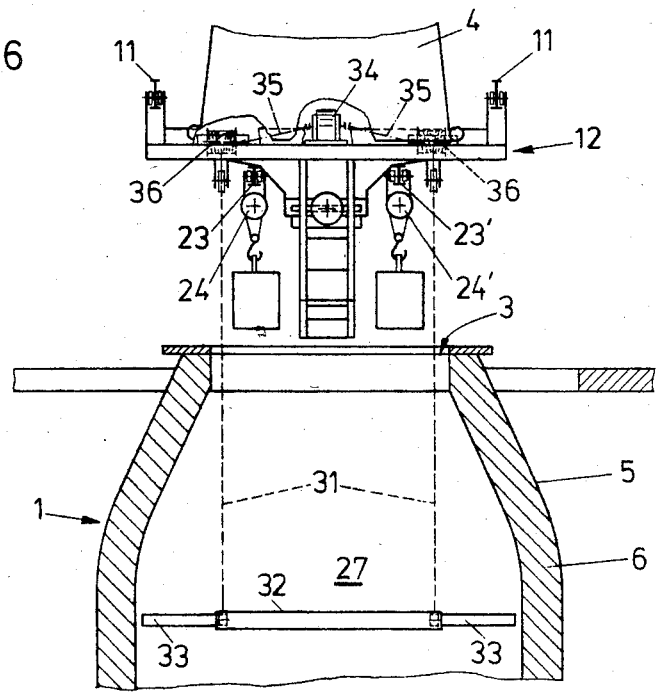

According to the embodiment illustrated in FIGS. 3 and 4, the container is comprised of two adjacently arranged hoppers 17, 17', the upper orifices 22, 22' of the hopers areally complementing each other in accordance with the lower end 8 of the chimney 4. The hoppers 17, 17' are symmetrical with respect to a plane 30 laid through the vertical axis 19 of the chimney 4 and the mouth 3 and parallel to the rails 11. Between the hoppers 17, 17', the runner 23 for the hoist 24 is provided at a distance as large as possible from the mouth 3, i.e. closely below the lower end 8 of the chimney 4. The runner 23 thus is disposed in the vertical plane 30 laid through the vertical axis 19 of the mouth 3, whereby the hoist 24 can be positioned exactly centrically above the mouth 3 of the converter 1 such that even larger pallets may easily be lowered into the interior 27 of the converter 1. According to the embodiment illustrated in FIGS. 5 and 6, one runner 23, 23' is each provided for a hoist 24, 24' on either side of the centrically arranged hopper 17. The carrying means 12 additionally carries a working platform 32, which is liftable and lowerable by means of a rope winch 31 that can be adapted to the shape of the interior 27 of the converter 1 by means of lateral projections 33. A drive motor 34 serves to lift and lower the working platform 32, which drive motor is coupled with the drums 36 winding up the ropes of the rope winches 31 via articulation shafts 35.

With the embodiments illustrated in FIGS. 3 and 4, and 5 and 6, respectively, it is also possible to guide the runners in both directions beside the mouth of the steel works converter such that two hoists may be provided per runner.

What I claim is:

1. In an installation with a refractorily lined metallurgical vessel, such as a steel works converter, of the type including a vessel mouth provided on the upper end of said metallurgical vessel, a chimney arranged at a distance above said mouth, a removable hood insertable between said vessel mouth and said chimney so as to connect said vessel mouth with said chimney, the improvement comprising a container to be introduced into the space available between said vessel mouth and said chimney after the removal of said hood so as to cover the lower end of said chimney and including at least one closeable bottom orifice, a carrying means for introducing said container, and at least one hoist provided on said carrying means and displaceable from laterally beside said vessel mouth to above said vessel mouth.

2. An installation as set forth in claim 1, wherein said carrying means is designed as a frame, and further comprising rails along which said frame is displaceable and at least one runner provided on said frame for said hoist and projecting to laterally beside said vessel mouth.

3. An installation as set forth in claim 2, wherein said runner is elongated on both sides of said vessel to lateral of said vessel mouth and carries two hoists.

4. An installation as set forth in claim 3, wherein two parallel runners are provided to accommodate at least one hoist each.

5. An installation as set forth in claim 2, wherein said container is formed by a hopper having a hopper orifice disposed centrally above said vessel mouth, and further comprising a slide for closing said hopper orifice, said runner being arranged closely beside said hopper orifice.

6. An installation as set forth in claim 2, wherein said container is formed by two adjacently arranged hoppers and said runner is arranged so as to lie between said hoppers in a plane laid through the vertical axis of said vessel mouth.

7. An installation as set forth in claim 1, wherein said carrying means is provided with an operation platform introduceable into said vessel through said vessel mouth.

8. An installation as set forth in claim 1, wherein said carrying means is provided with an accessible path.

9. An installation as set forth in claim 2 comprising a hood displaceable along said rails, wherein said carrying means is displaceable along said rails guiding said hood and is connectable to said hood.

10. An installation as set forth in claim 9, further comprising a moving mechanism for supporting said hood, said carrying means being connectable to said moving mechanism.

* * * * *